US005876517A

United States Patent [19]

Jeannier

[11] Patent Number: 5,876,517

[45] Date of Patent: Mar. 2, 1999

[54] CHROMATE-PLATING BATH AND PROCESS FOR FINISHING ZINC ZINC ALLOY OR CADMIUM SURFACES

[75] Inventor: Eliane Jeannier, Pontoise, France

[73] Assignee: Atotech Deutschland GmbH, Germany

[21] Appl. No.: 959,713

[22] Filed: Oct. 28, 1997

Related U.S. Application Data

[63] Continuation of Ser. No. 568,971, Dec. 7, 1995, abandoned.

[30] Foreign Application Priority Data

Dec. 7, 1994 [FR] France ..... 94 14701

[51] Int. Cl.[6] ..... C23C 22/24

[52] U.S. Cl. ..... 148/264; 106/14.21; 148/265; 148/266; 148/267; 148/268; 148/273; 148/274

[58] Field of Search ..... 148/264, 265, 148/266, 267, 268, 273, 274; 106/14.21

[56] References Cited

U.S. PATENT DOCUMENTS

| | | | |
|---|---|---|---|
| 2,393,640 | 1/1946 | King | 148/267 |
| 2,483,510 | 10/1949 | Stareck | 148/266 |
| 4,776,898 | 10/1988 | Verberne | 148/260 |
| 4,931,317 | 6/1990 | Shima et al. | 427/385.5 |
| 4,966,634 | 10/1990 | Saeki et al. | 148/251 |
| 5,178,690 | 1/1993 | Maiquez | 148/265 |

FOREIGN PATENT DOCUMENTS

| | | | |
|---|---|---|---|
| 0 087 288 | 8/1983 | European Pat. Off. . | |
| 0 274 543 | 7/1988 | European Pat. Off. . | |
| 0 508 207 | 10/1992 | European Pat. Off. . | |
| 947164 | 7/1949 | France . | |
| A-40 05112 | 6/1991 | Germany . | |
| 586517 | 3/1947 | United Kingdom | 148/266 |
| 2 216 905 | 10/1989 | United Kingdom . | |
| 2 255 783 | 11/1992 | United Kingdom . | |

OTHER PUBLICATIONS

Patent Abstracts of Japan, vol. 013, No. 255, 13 Jun. 1989; Japan 01–56877.

Patent Abstracts of Japan, vol. 014, No. 299, 27 Jun. 1990; Japan 02–97682.

Chemical Abstracts, vol. 94, No. 18, abstract No. 144073q, Dikinis.

Chemical Abstracts, vol. 111, No. 16, abstract No. 138906s, Marinescu.

English language translation of RO–A–94 238 Marinescu of which relates to the above Chemical Abstract, vol. 111, No. 16, abstract No. 138906s.

*Primary Examiner*—David A. Simmons
*Assistant Examiner*—Robert R. Koehler
*Attorney, Agent, or Firm*—Bell, Boyd & Lloyd

[57] ABSTRACT

Process for finishing zinc, zinc alloy or cadmium surfaces which consists in bringing the components to be treated into contact first with an acidic chromate-plating bath based on chromium, cobalt and silver salts and then with a top coat bath comprising a colloidal silica, a corrosion inhibitor, a complexing agent, a surfactant and a black dye.

9 Claims, No Drawings

CHROMATE-PLATING BATH AND PROCESS FOR FINISHING ZINC ZINC ALLOY OR CADMIUM SURFACES

This is a continuation divisional of application Ser. No. 08/568,971, filed on Dec. 7, 1995 now abandoned.

FIELD OF THE INVENTION

The present invention relates to the finishing of zinc, zinc alloy or cadmium surfaces for the purpose of conferring high corrosion resistance on them.

BACKGROUND OF THE INVENTION

It has been known for a long time that it is possible to improve the corrosion resistance of the said surfaces by subjecting them, after zinc plating, to a passivation treatment using chromate-plating baths. However, for components used under an engine bonnet and therefore subjected during use to thermal shocks and to corrosion, the requirements of the automobile industry have recently become more stringent since manufacturers now want the corrosion resistance to be in accordance after the said surfaces have been subjected to a thermal shock for one hour at 120° C. or even 180° C.

The corrosion resistance is assessed in the laboratory by an accelerated Salt Spray Test carried out according to the AFNOR NFX41002/ASTM B117 73/DIN40046-11 standard. The automobile industry wants components which have been subjected to a thermal shock to show no zinc salt (or white rust) after exposure to the salt spray for 200 hours and no red rust after 400 hours or indeed 600 hours. Moreover, also after thermal shock, the said components should also successfully undergo natural-corrosion tests.

Moreover, components intended for the automobile industry should satisfy aesthetic color requirements: yellow, green and more particularly black. This black color, which should be deep, glossy and uniform, is particularly difficult to obtain when, at the same time, a high corrosion resistance is demanded after thermal shock for one hour at 120° C.

Chromate-plating baths based on chromium, copper and silver or molybdenum which make it possible to obtain a shiny black coating are described in Patent FR 2,522,023. However, after thermal shock for one hour at 120° C., this type of coating does not last longer than 48 hours in the corrosion test with salt spray.

The use of a chromate-plating bath comprising an acrylic polymer and a phosphate makes it possible, according to Patent EP 264 472, to obtain a beautiful black coloring which is resistant to corrosion in salt spray after thermal shock. However, it is more difficult to bring such a bath into operation than a conventional chromate-plating bath. Moreover, the film obtained proves to be unstable (formation of yellow chromium salts) and the use of a polymer leads to the emergence of "drops" on the components treated on jigs and to difficulties in cleaning the equipment (centrifugal drier Jigs) used in the treatment.

It has also been proposed to subject the components to a conventional chromate plating and then to treat them in a separate bath containing the acrylic polymer and the phosphate. This two-stage process does not give reproducible results and, like the above process, has the disadvantage of leading to the formation of "drops".

It has now been found that, by using a chromate-plating bath comprising cobalt instead of copper and a top coat bath based on colloidal silica, it is possible to obtain, on zinc, zinc alloy or cadmium surfaces, a coating with a beautiful black colouring exhibitions excellent corrosion resistance in salt spray after thermal shock.

DESCRIPTION OF THE INVENTION

The subject of the present invention is therefore a process for finishing zinc, zinc alloy or cadmium surfaces, characterized in that the components to be treated are brought into contact first with an acidic chromate-plating bath based on chromium, cobalt and silver salts and then with an aqueous finishing bath comprising a colloidal silica, a corrosion inhibitor, a complexing agent, a surfactant and a black dye.

The chromate-plating bath according to the invention is an aqueous solution having a pH of between 1 and 2 and containing, per liter:

5 to 40 g (preferably 7 to 15 g) of hexavalent chromium ions, 5 to 20 g (preferably 7 to 12 g) of sulphate ions, 0.1 to 0.3 g (preferably 0.1 to 0.2 g) of cobalt ions, 0.1 to 0.65 g (preferably 0.15 to 0.3 g) of silver ions, and 50 to 150 ml (preferably 70 to 120 ml) of at least one weak organic acid.

In order to prepare the chromate-plating bath according to the invention, use is preferably made of sodium dichromate, cobalt sulphate and silver nitrate but it would not be departing from the scope of the present invention to use other water-soluble hexavalent chromium, cobalt or silver salts. Use is preferably made, as weak organic acid the role of which to reduce the hexavalent chromium and to control the attack of the zinc, of acetic acid, formic acid or oxalic acid. The pH of the chromate-plating bath, advantageously adjusted by means of sulphuric acid, is preferably between 1.2 and 1.8.

The top coat bath must be able to operate at a pH between 1 and 5, preferably between 2.5 and 4, and have excellent chemical stability without any gelling of the colloidal silica during storage or operation. To do this, the colloidal silica is present in the top coat bath to be used according to the invention at a concentration such that there are present from 20 to 40 g/l, expressed as $SiO_2$. The weak complexing agent, used at a concentration of 0.1 to 2 g/l, can be, for example, gluconic acid, oxalic acid, citric acid, maleic acid, phthalic acid or a potassium, sodium or ammonium salt of such an acid. The corrosion inhibitor is used at a concentration of 0.01 to 1 g/l and can be, for example, hydrazine hydrate or a benzoate such as sodium benzoate. The surfactant used at a concentration of 0.01 to 2 g/l can be of nonionic or anionic nature.

In order to improve the final appearance and without any negative effect on the corrosion resistance, it is possible to add to the finishing bath a water-soluble black dye, preferably a dye of the metal/azoiccomplex type, at a concentration of 1 to 8 g/l.

When it is desired that the surface, at the end of the treatment, should have a high abrasion resistance, it is possible to add PTFE particles of approximately 0.1 to 0.2 micron to the top coat bath. This product must be compatible with the pH of the medium of use; for an aqueous dispersion containing 60% of PTFE, the concentration can range from 1 to 10 ml/l. This also makes it possible, during treatment in a barrel of screw and bolt components, to obtain an appropriate coefficient of friction.

When an improved gritting resistance is desired, it is possible to incorporate an acrylic polymer in the top coat bath, for example an aqueous emulsion with a density of 1.055 g/ml at a concentration of 10 to 100 ml/l; it is also possible to use a polyethylene glycol.

The components can be brought into contact with the chromium-plating bath and then with the top coat bath by spraying, but the operation is preferably carried out by immersion. Depending on the nature of the components to be treated, this operation can be carried out on jigs (rack) or in a barrel (in bulk), with or without basket tranfer in the case of. barrel treatment.

The treatment can be carried out at a temperature ranging from 15° to 40° C., but is preferably carried out at a temperature of between 20° and 30° C. The period during which the components are brought into contact with each of the baths can vary within wide limits. It is generally between 10 seconds and 10 minutes, but is preferably from one to two minutes.

The chromium plating is advantageously carried out with agitation, the latter preferably being obtained by means of an air distribution pipe. After chromate plating, the components are not dried, but only rinsed with water before being brought into contact with the finishing bath, this treatment preferably being carried out without agitation. Finally, the components are dried for 5 to 15 minutes at a temperature ranging from 60° to 100° C. Their corrosion resistance is tested only after storing for at least 48 hours in order for the film formed to become stabilized.

EXAMPLES

The following example illustrates the invention without limiting it.

EXAMPLE

In order to treat components made of electrolytic zinc-plated steel, an aqueous chromium-plating bath was prepared with 30 g/l of sodium dichromate dihydrate, 5 g/l of anhydrous sodium sulphate, 8 g/l of sulphuric acid, 0.6 g/l of cobalt sulphate heptahydrate, 0.37 g/l of silver nitrate and 85 ml/l of acetic acid.

The components were immersed for 90 seconds in this bath, maintained at a temperature of 24° C. and with air agitation, then rinsed with water and immersed for one minute at 20°–22° C. in an aqueous finishing bath which contains, per liter:

| | |
|---|---|
| colloidal silica(*) | 27 g (expressed as $SiO_2$) |
| sodium gluconate | 0.2 g |
| sodium benzoate | 0.02 g |
| fluorinated surfactant(**) | 0.1 g |
| aqueous dispersion containing 60% of PTFE | 5 ml |
| black dye(***) | 4 g |

(*)Sodium-containing colloidal silica having a mean particle diameter of 12 nm, a specific surface of 230 $m^2/g$ and a viscosity at 25° C. of 9 mpa.s
(**)Tetraethylammonium perfluorooctane-sulphonate
(***)Metal/azo complex.

On leaving this bath, the glossy black components were not rinsed, but dried directly at 80° C. for 10 minutes.

(*) Sodium-containing colloidal silica having a mean particle diameter of 12 nm, a specific surface of 230 $m^2/g$ and a viscosity at 25° C. of 9 mPa.s Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

I claim:

1. Chromate-plating bath, consisting essentially of an aqueous solution having a pH of between 1 and 2 and containing, per liter, 5 to 40 g of hexavalent chromium ions, 5 to 20 g of sulphate ions, 0.1 to 0.3 g of cobalt ions, 0.1 to 0.65 g of silver ions and 50 to 150 ml of at least one organic acid.

2. Chromate-plating bath according to claim 1, consisting essentially of a pH of between 1.2 and 1.8 and, per liter, 7 to 15 g of hexavalent chromium ions, 7 to 12 g of sulphate ions, 0.1 to 0.2 g of cobalt ions, 0.15 to 0.3 g of silver ions and 70 to 120 ml of organic acid.

3. Chromate-plating bath according to claim 1, wherein the organic acid is acetic acid, formic acid or oxalic acid.

4. Chromate-plating bath according to claim 1, wherein it is prepared from sodium dichromate, cobalt sulphate and silver nitrate.

5. Process for finishing zinc, zinc alloy or cadmium surfaces, wherein the components to be treated are brought into contact first with a chromate-plating bath according to claim 1 and then with a top coat bath having a pH of between 1 and 5 and containing, in water and per liter, 20 to 40 g (expressed as $SiO_2$) of a colloidal silica, 0.1 a to 2 g of a complexing agent, 0.01 to 1 g of a corrosion inhibitor, 0.01 to 2 g of a surfactant and 1 to 8 g of a water-soluble black dye.

6. Process according to claim 5, wherein the top coat bath additionally contains PTFE particles and/or an acrylic polymer.

7. Process according to claim 5, wherein the treatment is carried out at a temperature ranging from 15° to 40° C.

8. Process according to claim 7, wherein the temperature is between 20° and 30° C.

9. Chromate-plating bath consisting of an aqueous solution having a pH of between 1.2 and 1.8 and containing per liter 7–15 g of hexavalent chromium ions, 7–12 g of sulphate ions, 0.1 to 0.2 g of cobalt ions, 0.15–0.3 g of silver ions and 70–120 ml of a organic acid wherein zinc, zinc alloy or cadmium surfaces are finished with a deep, glossy and uniform color and having substantial corrosion resistance, resistant to thermal shock showing substantially no white rust nor red rust after exposure to salt spray for at least 200 hours.

* * * * *